United States Patent [19]

Jensen et al.

[11] 4,152,172

[45] May 1, 1979

[54] METHOD FOR CLEANING RAISED TERMINAL PADS OF SEMICONDUCTOR ELEMENTS

[75] Inventors: Niel F. Jensen; James E. O'Keefe, both of Phoenix, Ariz.

[73] Assignee: Honeywell Information Systems Inc., Phoenix, Ariz.

[21] Appl. No.: 865,545

[22] Filed: Dec. 29, 1977

[51] Int. Cl.[2] ..... B08B 1/00

[52] U.S. Cl. ..... 134/6; 29/590; 51/326; 51/328

[58] Field of Search ..... 134/6; 15/3.53, 97 R, 15/102; 29/590; 51/21, 59 R, 326, 328

[56] References Cited

U.S. PATENT DOCUMENTS

| | | | |
|---|---|---|---|
| 2,015,603 | 9/1935 | Maris | 134/6 |
| 4,024,596 | 5/1977 | Rioux | 134/6 X |

*Primary Examiner*—Marc L. Caroff

*Attorney, Agent, or Firm*—Edward W. Hughes; W. W. Holloway, Jr.; R. T. Reiling

[57] ABSTRACT

Method and apparatus for cleaning the top surfaces of raised input/output (I/O) terminals of semiconductor elements of a semiconductor wafer prior to electronic leads being reflow bonded to such terminals. The top surfaces of the I/O terminals substantially lie in I/O plane. The wafer is mounted on a work handler and the handler is fixedly mounted on a vacuum plate holder which is mounted for oscillatory movement in a plane at a predetermined amplitude and frequency. A vinyl eraser having a planar surface of greater area than the area of the wafer occupied by the elements is mounted directly above the wafer. The eraser is operatively connected to an actuator which presses the planar surface of the eraser against the top surfaces of the I/O terminals with a predetermined force. Oscillation of the work handler holder with respect to the eraser for a predetermined time causes the top surfaces of the I/O terminals to rub against the planar surface of the eraser, which cleans them without the eraser contacting the upper surface of the semiconductor elements or damaging the I/O terminals, and results in the I/O terminals being ready to be reflow bonded to electronic leads without further preparation.

8 Claims, 8 Drawing Figures

METHOD FOR CLEANING RAISED TERMINAL PADS OF SEMICONDUCTOR ELEMENTS

BACKGROUND OF THE INVENTION

1. Field of the Invention

This invention is in the field of methods and apparatus for cleaning the top surfaces of raised I/O terminals of semiconductor elements of a semiconductor wafer by relative movement between the top surfaces of the I/O terminals and a planar surface of mild abrasive pressed against such surfaces.

2. Description of the Prior Art

Some integrated circuits (IC) chips are provided with I/O terminals or bumps. These I/O terminals or I/O bumps are made out of gold, for example, and project a substantial distance above the passivation layer of such chips; on the order of from 15 to 26 microns. Chips with I/O bumps are produced by conventional manufacturing techniques starting with a wafer cut from a single crystal of essentially pure silicon. A large number of large scale IC chips can be obtained from one such wafer. The portions of the wafer which become an IC chip while still an integral part of a wafer is referred to in this application as elements. The semiconductor elements after being severed by sawing are thereafter called chips. The I/O bumps of each element, or chip, are formed on the IC elements while they are still integral with the wafer.

To facilitate automating the process of reflow bonding leads to the I/O bumps of chips, a step in the process of manufacturing electronic devices, it is desirable that the outer surfaces of all the bumps of an element, and in fact all the bumps of all the elements of a wafer lie in the same plane, the I/O plane, which I/O plane is spaced above the upper surface of the wafer and is substantially parallel to the upper surface of the wafer, and thus to the upper surfaces of the elements of the wafer. The I/O bumps are most commonly made of a noble metal such as gold because of the resistance of such metals to corrosion, and because such metals are reliably reflow bondable to electronic leads. However, in reflow bonding I/O bumps of such chips to electronic leads, the strength of the reflow bonds, or joints, varies widely with many being unacceptably weak while others are satisfactorily strong. Such variations occur even between I/O terminals of one chip as well as between the I/O terminals, or bumps, of chips from the same wafer. The exact cause of the variation in bond strength between an I/O bump and electronic lead bonded to the bump is not known. It is believed that notwithstanding the characteristics of gold, for example, that the top surfaces of the I/O bumps are adversely affected by the process steps that occur between the time the I/O bumps are formed and the IC chips are bonded to a lead frame with the result that the strength of the bonds vary widely. Tests have revealed traces of some metals on the surface of the I/O bumps such as titanium, which is used in some of the process steps, and it is also believed that organic materials may be adversely affecting the exposed surfaces of the I/O bumps. At this time, however, the exact cause of vibration in strength of solder bonds is not known.

SUMMARY OF THE INVENTION

Applicants have discovered that by lightly abrading the top surfaces of I/O bumps of IC elements, or chips, with a mild abrasive such as a vinyl eraser, that the standard deviation of the strengths of the reflow bonds between electronic leads reflow bonded to such I/O bumps is significantly reduced. As a result, it is possible to reliably reflow bond tinplated copper electronic leads to the gold I/O bumps so cleaned. The strength of such bonds is well above the minimum acceptable strength for such joints. In addition, the failure mode is changed from inner bond failure, a failure at the interface between a lead and the top surface of a bump, to lead failure or I/O bump failure. In a lead failure, the lead fails and in an I/O bump failure, the I/O bump fails rather than the failure occurring at the interface between a lead and the bump to which it is bonded.

The present invention therefore provides method and apparatus for cleaning the top surfaces of the I/O bumps of IC elements of a semiconductor wafer and in doing so solves the problem of being able to reliably reflow bond electronic leads to the I/O bumps of IC chips obtained from such a wafer.

It is therefore an object of this invention to provide a method for cleaning the top surfaces of the I/O bumps of semiconductor devices.

It is another object of this invention to provide apparatus for lightly abrading the top surfaces of the I/O bumps of semiconductor devices.

It is yet another object of this invention to provide a process that increases the strength and reliability of the reflow bonds between electronic leads and I/O bumps of IC chips.

BRIEF DESCRIPTION OF THE DRAWINGS

Other objects, features and advantages of the invention will be readily apparent from the following description of a preferred embodiment thereof, although variations and modifications may be effected without departing from the spirit and scope of the novel concepts of the disclosure, and in which.

DESCRIPTION OF THE PREFERRED EMBODIMENT

Figure 1:
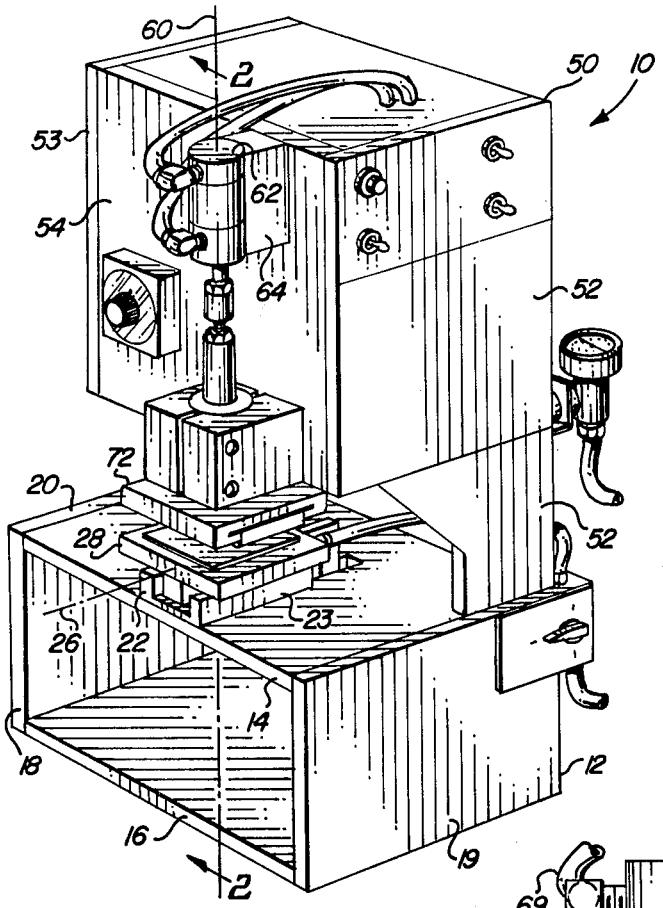
FIG. 1 is a perspective view of the apparatus of the invention.

In FIG. 1 apparatus, or terminal pad scrubber, 10 has a base 12 which consists of a top base plate 14, a bottom base plate 16 and two side plates 18 and 19. The top surface 20 of top base plate 14 is substantially planar, and base 12 is normally positioned on a support, or table, which is not illustrated, so that the top surface 20 of base 12 is substantially horizontal. A ball slide 22 which has a base 23 and a movable element 24 has its base 23 mounted on the upper surface 20 of base 12. Ball slide 22 has a slide axis 26 along which the movable element 24 can move. A vacuum plate, or holder, 28 is mounted on the movable element 24 of ball slide 22 so that it moves with the movable element 24. Vacuum plate 28 is adapted to be connected to a source of vacuum, which is not illustrated, by conventional vacuum hose, or tubing, 30. Vacuum plate 28 is provided with a positioning guide 32 to properly position a handling plate, or nest plate, 34 on vacuum plate 28 so that handling plate 34 is over the opening 36 in the vacuum plate so that when opening 36 formed in the top surface of vacuum plate 28 is connected to a convenient source of vacuum, which is not illustrated, and a handling plate 34 is positioned over vacuum plate 28 by positioning guide 32, handling plate 34 will be fixedly secured to the handling plate.

Figure 2:
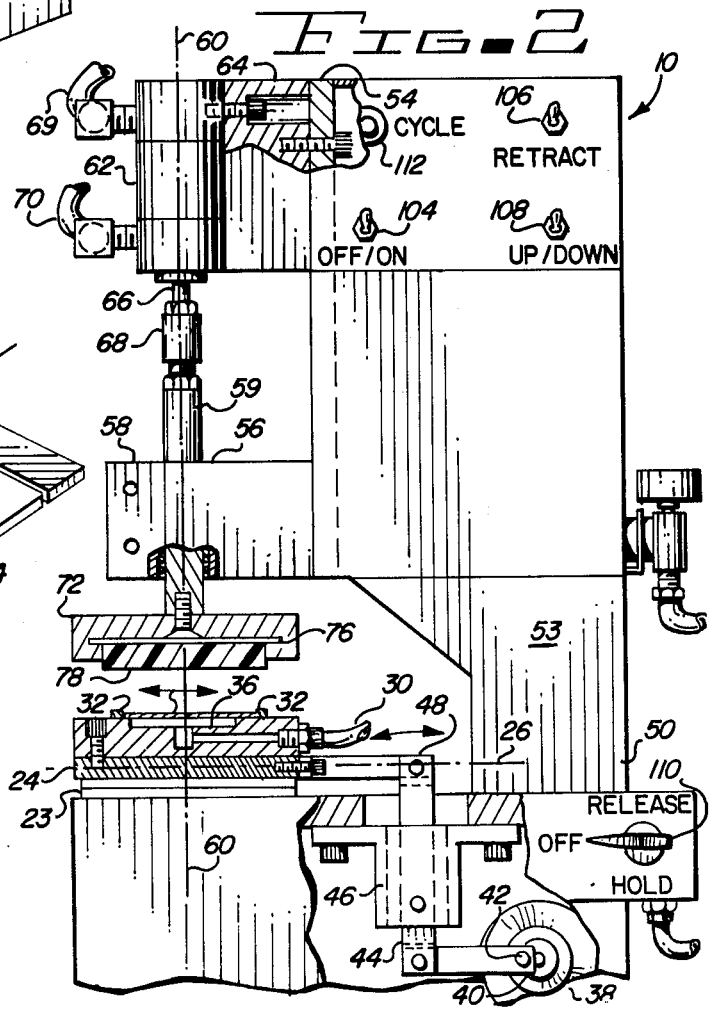
FIG. 2 is a section taken on line 2—2 of FIG. 1.

To cause movable element 24 of ball slide 22 to oscillate along slide axis 26, a variable speed electric motor 38 is mounted on the bottom base plate 16 and is geared to shaft 40 on which is mounted an eccentric pivot pin 42. Pivot arm 44 is pivotally mounted on bracket 46 whch is secured to the bottom side of top base plate 14 as is best seen in FIG. 2. The upper portion of arm 44 is connected to the movable element 24 of slide 22 by yoke 48. The linkage between the motor 38 and the movable element 24 is such as to cause the movable element to oscillate along its axis 26 at a frequency that is determined by the speed of the motor 38, and the reduction in the speed of the motor by a gear box between motor 38 and shaft 40. The amplitude of the oscillations of element 24 is determined in the preferred embodiment by the location of the pivot pin 42 with respect to the center or axis of rotation of shaft 40 as is well known in the art.

An upper support housing 50 is mounted on base 12 and projects above the upper surface 20 of top plate 14 as is seen in FIGS. 1 and 2. Housing 50 has a pair of side plates 52 and 53 and a front plate 54 which is secured to the side plates 52 and 53. A cylindrical ball slide 56 is mounted on support housing 50 by slide holder 58. The movable element 59 of slide 56 is free to move parallel to slide axis 60. Slide holder 58 positions slide 56 so that its axis 60 is substantially perpendicular to the top surface 20 of base 12. A conventional actuator 62, which can be a pneumatic cylinder in a preferred embodiment, is mounted on front plate 54 by actuator bracket 64 so that the longitudinal axis of the piston rod 66 of actuator 62 substantially coincides with the slide axis 60.

Piston rod 66 is connected to movable element 59 of cylindrical ball slide 56 by connector 68. Actuator 62 is connected by compressed air lines 69, 70 to a conventional source of compressed air which is not illustrated.

An eraser retainer 72 is mounted on the bottom of movable element 59 of ball slide 56. Pad 74 of a mild abrasive, such as a vinyl eraser, is secured to eraser mounting plate 76, typically by means of a contact cement, and mounting plate 76 is dimensioned to fit into a pair of grooves formed in eraser retainer 72 as is seen in FIG. 2. An eraser manufactured and sold by the Faber-Castell Corporation under the trade name of Magic Rub No. 1954 is suitable for fabricating eraser pad 74. Eraser pad 74 has a bottom planar surface 78, and when eraser 74 is mounted on the eraser retainer 72, its planar surface 78 is substantially parallel to top surface 20 of base 12.

Figure 7:
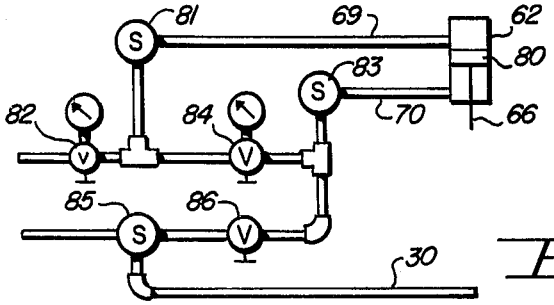
FIG. 7 is a schematic drawing of the pneumatic controls for the apparatus.

Referring to FIG. 7, actuator 62, which is shown schematically, has a piston 80 which is connected to the piston rod 66 of actuator 62. Compressed air line 69 is connected through valve 81 and pressure regulator 82 to a conventional source of compressed air. Compressed air line 70 is connected through valve 83 to pressure regulator 84. Pressure regulator 84 is connected so that the pressure of the compressed air supplied to it is determined by pressure regulator 82 as seen in FIG. 7. Vacuum hose 30 which is connected to vacuum plate 28 is connected to a source of vacuum, or air at less than atmospheric pressure, through three-way valve 85. Air from pressure regulator 84 can flow through pressure regulator 86 and valve 85 to the opening 36 in vacuum plate 28. Pressure regulator 86 is adjusted so that only a very slight positive pressure is applied to opening 36, just enough to lift slightly handling plate 34 located within positioning guides 32 as seen in FIG. 3 to facilitate removing it.

Pressure regulator 84 is adjusted so that the pressure on the bottom side of the piston 80 when valve 83 is open is slightly less than the pressure on the upper side of piston 80 which is determined by pressure regulator 82 when valve 81 is open. By adjusting pressure regulators 82 and 84 it is possible to control the pressure exerted by the piston 80 and the pressure of eraser pad 74 against the I/O pads of I/O elements placed on vacuum plate 28 as will be described later.

Figure 8:
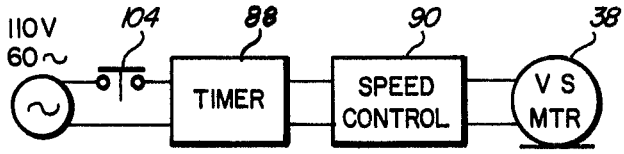
FIG. 8 is a schematic of the electrical controls of the apparatus.

FIG. 8 is a schematic diagram of the electrical controls which determine the speed and the time that motor 38 is energized. A conventional timer 88 is used to control the application of alternating current, 110 volt 60 Hz AC, to motor 38. The speed of motor 38 is controlled by a conventional AC motor speed control 90, such as a variable resistor. In a preferred embodiment the speed of shaft 40 ranges from 50 to 100 rpm.

Figure 3:
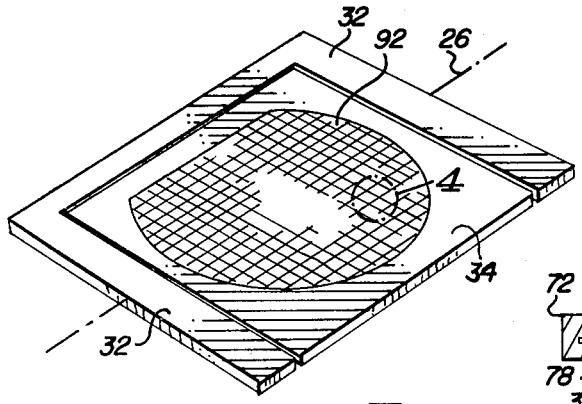
FIG. 3 is a perspective view of a semiconductor wafer mounted on a holding plate.
Figure 4:
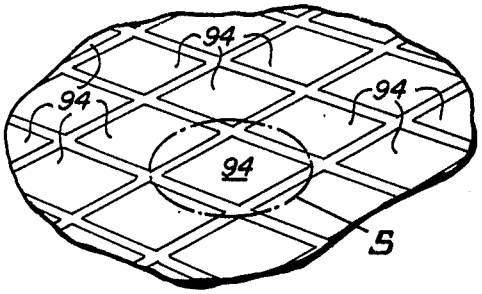
FIG. 4 is a view of a portion of the semiconductor wafer illustrated in FIG. 3 at a greatly enlarged scale.
Figure 5:
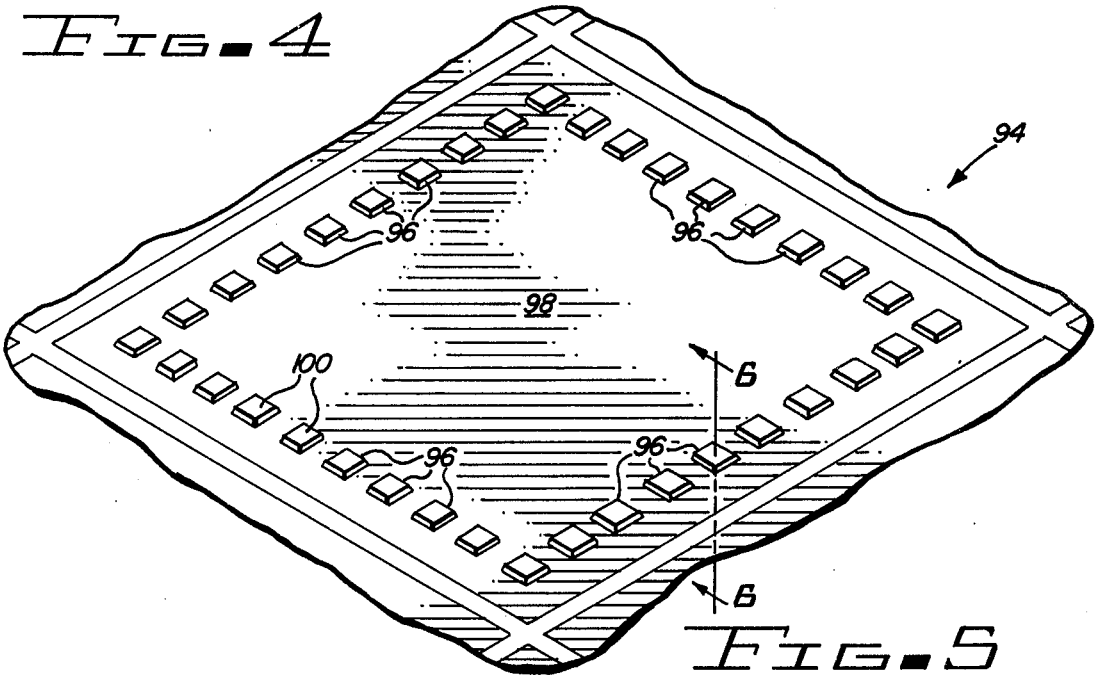
FIG. 5 is a greatly enlarged view of a semiconductor element of FIG. 4.

In FIG. 3 a wafer 92 cut from a crystal of silicon on which has been formed integrated circuit elements 94 is mounted on handling plate 34. In FIG. 4, which is greatly enlarged compared to FIG. 3, a number of the elements 94 are seen, and in FIG. 5, which is enlarged still more compared with FIG. 4, relevant details of an element 94 are illustrated. Element 94 is provided with a plurality of I/O terminals, or bumps, 96 which project above the upper surface 98 of element 94 a distance in the range of from 15 to 26 microns. The top surface 100 of each I/O bump 96 is essentially flat and lies in an I/O plane which is substantially parallel to the upper surface 98 of element 94 illustrated in FIG. 5 and the top surface of wafer 92. As can be seen in FIG. 5, the I/O bumps, or elements, 96 are arranged around the perimeter of element 94 and ten I/O terminals 96 are illustrated as being formed on two sides of element 94 and nine on the other two sides.

Figure 6:
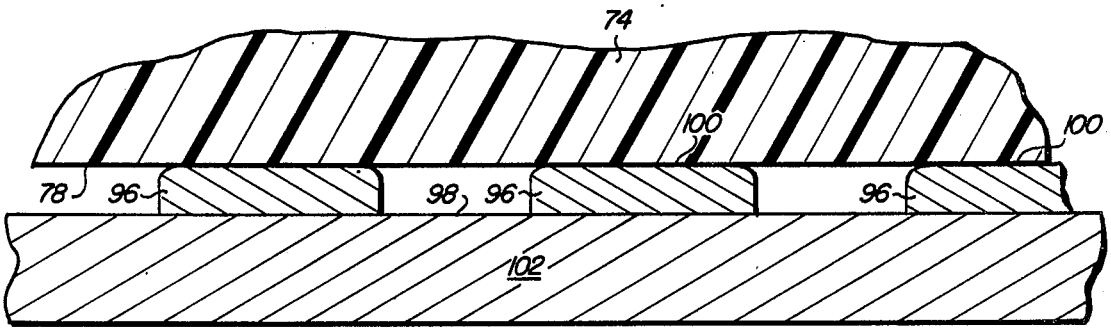
FIG. 6 is a section taken on line 6—6 of FIG. 5.

As seen in FIG. 6, the bumps 96 project above the semiconductor base 102 of an element 94 a distance of about, as mentioned earlier, 1 mil or 25 microns. The spacing between I/O bumps 96, in a preferred embodiment, is substantially 4 mils, and the dimensions, length and width of each bump 96, which in a preferred embodiment are substantially square, is 6 mils.

After the elements 94 have been formed on a semiconductor wafer 92 and I/O bumps 96 have been formed to make connections with the metalization layers of the elements, which are not shown since they form no part of this invention, wafer 92 is mounted on handling plate 34 by being secured to it by wax, for example. Plate 34 is then ready to be placed on vacuum plate, or holder, 28 of scrubber 10. To prepare scrubber 10 for operation off/on switch 104 is turned on which applies 60 Hz AC to timer 88. The pneumatic system illustrated in FIG. 7 is connected to a source of compressed air and to a source of vacuum. Valve 83 is placed in its open position by lever 106 which supplies compressed air to the underside of piston 80 to drive piston 80 upward. Valve 81 is closed by lever 108 being in its up position. The handle 110 of valve 85 is positioned at off so that neither a vacuum source nor compressed air source is connected to opening 36 through tube 30.

With eraser retainer 72 in its up position as illustrated in FIG. 2, access to vacuum plate 28 can be obtained by an operator to place a handling plate 34 on the vacuum plate with the plate 34 overlaying opening 36. Positioning guides 32, best seen in FIG. 3, are used to accurately position handling plate 34 so that wafer 92 is substantially in the center of vacuum plate 28 with the center of wafer 92 substantially lying on the axis 60 of vertical slide 56. Handle 110 of three-way valve 85 is turned so that opening 36 is connected to a source of vacuum to fixedly secure plate 34 to vacuum plate 28. Guides 32 are formed on three sides of handling plate 34, as seen in FIG. 3, and help prevent any relative movement between plate 34 and vacuum plate 28 when vacuum plate 28 is oscillated along axis 26. Timer 88 is set so that motor 38 will be energized for a predetermined time, 30 seconds in a preferred example, when cycle button 112 is pushed. The speed of shaft 40 is determined by the speed of motor 38 which is controlled by conventional speed control 90. In a preferred embodiment the frequency of oscillation of vacuum plate 28 is in the range of from 50 to 100 cpm.

When nesting plate 34 is properly positioned on vacuum plate 28, and handle 110 has been turned to "hold" so that nesting plate 34 is forced against vacuum plate 28 by the pressure differential across nesting plate 34, the operator pushes cycle button 112 which energizes motor 38 and causes vacuum plate 38 to oscillate at a predetermined frequency and amplitude determined by the speed of motor 38 and the position of pivot pin 42. In a preferred embodiment the amplitude of the oscillations of vacuum plate 28 is in the range of from one-sixteenth to one-half of an inch. Immediately after pushing cycle button 112, the operator moves lever 108 down to open valve 81 which drives cylinder 80 downwardly until the bottom planar surface 78 of eraser pad 74 contacts the top surfaces 100 of I/O bumps 96 as illustrated in FIG. 6. The pressure differential across piston 80 is chosen so that the pressure at the face 78 of eraser 74 is approximately 1 lb. per sq in over the area of wafer 92. The force applied to each I/O bump is on the order of 0.001 to 0.002 lbs. The size, or area of surface, 78 of eraser 74 is made such that it is slightly larger than the size of handling plate 34, as a result wafer 92 and I/O bumps 96 of elements 94 of wafer 92 will be in contact with surface 78 of eraser 74 during each cycle of oscillation of vacuum plate 28 after surface 78 is brought into contact with the top surfaces 100 of I/O bumps 96.

After the I/O bumps have been cleaned in this manner, the elements 94 are separated by sawing in the areas between elements to produce IC chips and the IC chips are then ready to be bonded to electronic leads. As a result of the method and the apparatus of this invention, the process of producing good reflow bonds between the raised I/O terminals, or bumps, of integrated circuit chips and leads reflow bonded to them has been made more reliable and the strength of such bonds significantly increased. In addition, the variables associated with cleaning of I/O bumps by hand have been eliminated as well as the labor costs associated therewith.

What is claimed as our invention is:

1. The method of cleaning the top surfaces of I/O bumps of semiconductor elements of a semiconductor wafer, the top surfaces of the I/O bumps substantially lying in an I/O plane with the planar surface of a mild abrasive comprising the steps of:

mounting a semiconductor wafer on a holder;

causing relative oscillations to occur in a plane substantially parallel to the I/O plane of the wafer between the holder and the planar surface of the mild abrasive at a predetermined frequency and amplitude for a predetermined period of time; and causing the planar surface of the abrasive to contact the top surfaces of the bumps with a predetermined force during the period they oscillate with respect to one another.

2. The method of claim 1 in which the predetermined frequency is substantially in the range of from 50 to 100 cycles per minute, the amplitude of the oscillations substantially in the range of from one-sixteenth to one-half inch, and the period of time the holder is oscillated is substantially in the order of 30 seconds.

3. The method of claim 2 in which the predetermined force is substantially in the range of from 0.001 to 0.002 lbs. per bump.

4. The method of claim 3 in which the abrasive is a vinyl eraser.

5. The method of cleaning the top surfaces of I/O bumps of semiconductor elements of a semiconductor wafer, the top surfaces of the I/O bumps substantially lying in an I/O plane comprising the steps of:

mounting the semiconductor wafer on a handling plate;

mounting the handling plate on a holder;

oscillating the holder along a straight line in a horizontal plane substantially parallel to the I/O plane of a semiconductor wafer mounted on said holder at a predetermined frequency and amplitude for a predetermined period of time; and pressing the planar surface of a mild eraser against the top surfaces of the bumps with a predetermined force after the holder has started oscillating and until the predetermined period of time in which the holder is oscillated ends.

6. The method of claim 5 in which the predetermined frequency is in the range of from 50 to 100 cycles per minute, the amplitude of the oscillation is substantially in the range of from one-sixteenth to one-half inch and the period of time the holder is oscillated is substantially 30 seconds.

7. The method of claim 6 in which the predetermined force is substantially in the range of from 0.001 to 0.002 lbs. per bump.

8. The method of claim 7 in which the mild eraser is a vinyl eraser.

* * * * *